US005959508A

United States Patent [19]

Aitken

[11] Patent Number: 5,959,508

[45] Date of Patent: Sep. 28, 1999

[54] ELECTROMAGNETIC WAVE COMBINING DEVICE AND TELEVISION BROADCAST TRANSMISSION SYSTEM USING SAME

[75] Inventor: Mark Aitken, Southwick, Mass.

[73] Assignee: Thomcast Communications, Inc., Southwick, Mass.

[21] Appl. No.: 08/905,160

[22] Filed: Aug. 1, 1997

[51] Int. Cl.[6] ..... H01P 1/213

[52] U.S. Cl. ..... 333/126; 333/135; 333/21 A; 343/786

[58] Field of Search ..... 333/125, 126, 333/135, 137, 21 R, 21 A, 239; 343/786

[56] References Cited

U.S. PATENT DOCUMENTS 2,985,850 5/1961 Crawford et al. ..... 333/137 X
3,223,948 12/1965 Bowman ..... 333/125 X
5,614,916 3/1997 Mizuguchi ..... 333/21 A X

FOREIGN PATENT DOCUMENTS 3-296301 12/1991 Japan ..... 333/21 A

*Primary Examiner*—Paul Gensler
*Attorney, Agent, or Firm*—Rothwell, Figg, Ernst & Kurz

[57] ABSTRACT

Apparatus is provided for allowing two high frequency signals from two separate sources to be combined for simultaneous propagation through a common propagation medium such as an antenna or transmission line, while maintaining isolation between the signals at the inputs of the sources and preventing unwanted interference and resulting distortion. The apparatus includes an orthogonal mode converger which receives two combined electromagnetic energy waves having orthogonally disposed electric field vectors and incrementally converges them to the same direction through a varying cross-section waveguide structure.

11 Claims, 4 Drawing Sheets

ELECTROMAGNETIC WAVE COMBINING DEVICE AND TELEVISION BROADCAST TRANSMISSION SYSTEM USING SAME

BACKGROUND OF THE INVENTION

1. Field of the Invention

The present invention relates generally to transmission of radio frequency (RF) signal waves and specifically to the combination of different RF signal waves of various frequencies into a common transmission line, such as a waveguide, for application to a common propagating device such as an antenna for further transmission of the electromagnetic wave.

2. Background and Related Art

In electronic apparatus concerned with amplification and transmission of electromagnetic energy, the energy is usually transferred from one component of the system to another in the form of current through electrical conductors such as wire or cable. At very high frequencies and high power, the transfer of electrical energy through current carrying conductors becomes inefficient and impractical. Instead of transferring electrical energy as current through conductors, the high frequency high power energy can be transmitted by electromagnetic waves constrained within a guiding structure or waveguide. The transmission of energy by waveguide is carried out by radiating the energy, in the form of electromagnetic waves, into the inside of the waveguide structure through various coupling mechanisms such as probes, loops, crossbars and the like. This same energy may be extracted from the waveguide by a similar coupling mechanism at another location on the waveguide.

Many applications exist where it is desired to combine signals of various frequencies into a common transmission line structure. One example of such an application is in the field of microwave communications. One requirement of such combination is that the different signals must not improperly interfere with each other.

In this regard, various tuned filtering devices have been used in the prior art. However, due to the non-ideal nature of such devices, unwanted distortions and losses are inevitably introduced into the frequency bands of the different signals, causing the signals to be degraded in quality.

One particular application for combining electromagnetic signal waves has arisen with the advent of digital television (DTV). Broadcasters who wish to provide DTV service still must provide broadcast signals in the conventional NTSC (National Television Systems Committee) format to accommodate viewers with conventional NTSC television receivers. Absent a feasible and efficient way to combine the DTV signal and the NTSC signal for transmission by a common broadcast antenna (possibly on adjacent frequency channels) without causing unacceptable interference, interaction and distortion of the signals, this will require some broadcasters to build additional antennae and towers to carry their DTV signals. This represents a very expensive and undesirable proposition.

Accordingly, there exists a need in the art to enable the combination of multiple signals of different frequencies without mutual interference and distortion.

SUMMARY OF THE INVENTION

The present invention provides a solution to the shortcomings of the prior art as discussed above.

In particular, the present invention provides apparatus for combining electromagnetic energy waves for transmission to a common propagation device such as an antenna, comprising first waveguide means for receiving at separate inputs thereof two electromagnetic energy waves having electric field vectors orthogonally disposed with respect to each other, combining said orthogonally disposed waves and outputting the combined orthogonally disposed waves at a common output passage thereof; and second waveguide means for receiving at an input thereof said combined orthogonally disposed waves, converging said orthogonally disposed waves such that the electric field vectors thereof are disposed parallel to each other, and outputting the combined parallel disposed waves at an output passage thereof for transmission to a common propagation device, such as a further transmission line or an antenna.

According to another aspect of the invention, a television broadcast transmission system is provided, comprising a first broadcast transmitter which outputs a first RF television signal electromagnetic energy wave in a first format; a second broadcast transmitter which outputs a second RF television signal electromagnetic energy wave in a second format; first waveguide means for receiving at separate inputs thereof said first and second electromagnetic energy waves having electric field vectors orthogonally disposed with respect to each other, combining said orthogonally disposed waves and outputting the combined orthogonally disposed waves at a common output passage thereof; and second waveguide means for receiving at an input thereof said combined orthogonally disposed waves, converging said orthogonally disposed waves such that the electric field vectors thereof are disposed parallel to each other, and outputting the combined parallel disposed waves at an output passage thereof for transmission to a common antenna.

DESCRIPTION OF THE DRAWINGS

The invention will be described in detail with reference to the following drawings in which.

DETAILED DESCRIPTION OF PREFERRED EMBODIMENTS

Figure 1:
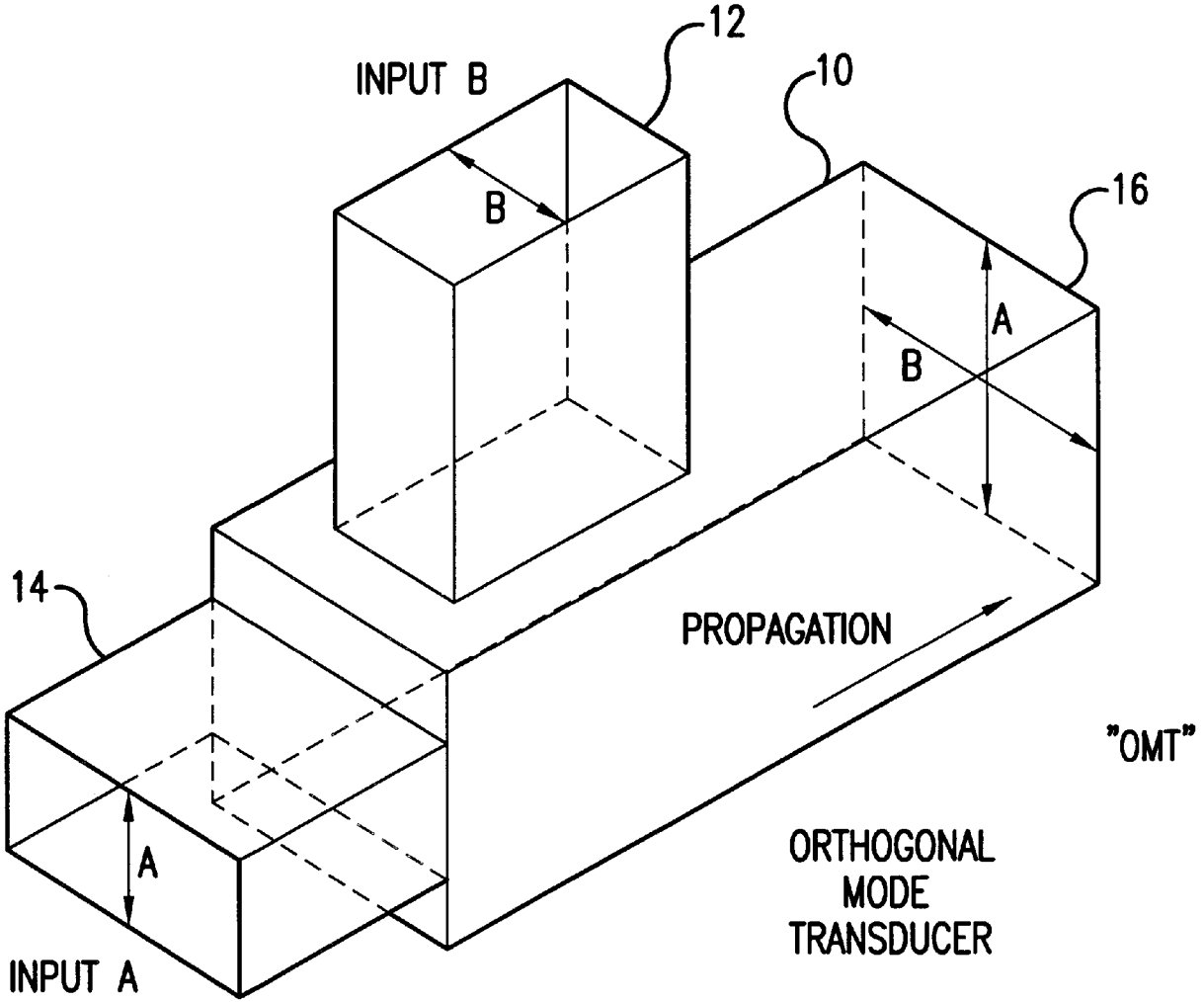
FIG. 1 is a perspective diagram of a conventional orthogonal mode transducer, which is used in the present invention.

FIG. 1 is a diagram of a conventional device known as an orthogonal mode transducer (OMT). An example of an orthogonal mode transducer for microwave energy transmission is disclosed in U.S. Pat. No. 3,004,228.

An orthogonal mode transducer is a waveguide device used to combine two electromagnetic energy waves of various frequencies into a single waveguide propagating device, while maintaining isolation of each of the inputs to reflection of the other wave. A single waveguide medium 10 has an input arm 14 into which an electromagnetic wave A having a vertically disposed electric field vector is inputted, and a second input arm 12 into which a second electromagnetic wave B having an electric field vector disposed orthogonally with respect to wave A is inputted. Each electromagnetic wave may be in the dominant $TE_{10}$ mode. Because the electric field vector orientation of waves A and B are orthogonal to each other, energy from wave B cannot propagate into arm 14, and energy from wave A cannot propagate into arm 12. The OMT thus maintains isolation between the inputted signals. However, because the signal waves are isolated at the output 16 of the OMT, they cannot be fed to a common broadcast antenna, because such an antenna is able to receive waves of a single electric field vector orientation at its coupling input.

Figure 2A:
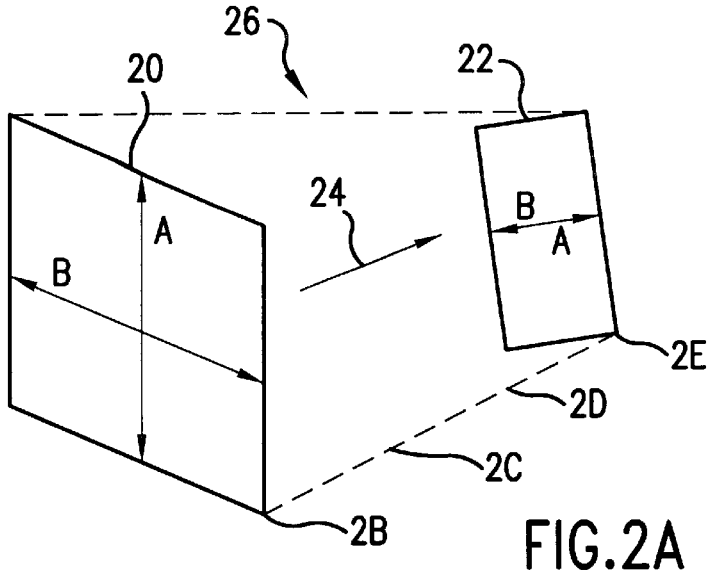
FIGS. 2A–2E are diagrams illustrating the concept of orthogonal mode convergence according to the present invention.
Figure 2B:
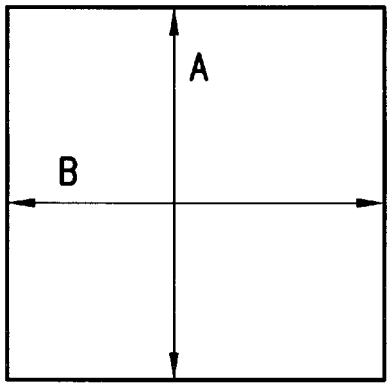
Figure 2C:
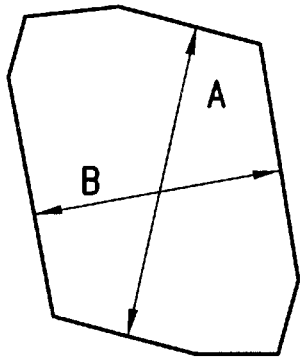
Figure 2D:
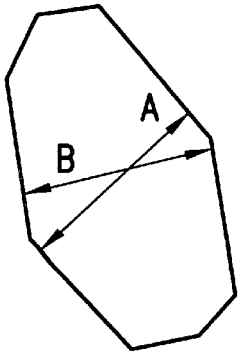
Figure 2E:
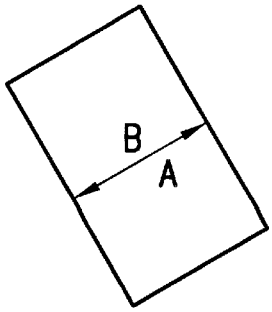

FIG. 2A illustrates the concept of an orthogonal mode converger (OMC) 26 according to the present invention. This novel device according to the invention provides a transitional waveguide structure which receives the combined orthogonal waves outputted by the OMT and realigns the orthogonal electric field vectors of the two waves to converge to the same or parallel orientation.

In particular, the orthogonal waves A and B are received by square shaped input passage 20 and are incrementally realigned along the direction of propagation 24 to converge at the rectangular shaped output passage 22. FIGS. 2B–2E illustrate the incremental reorientation and realignment of the electric field vectors at corresponding labeled locations of FIG. 2A. As shown, the direction of the orthogonal vectors are incrementally shifted toward each other. Thus, the OMC in effect can be described as "compressing" the dimensions of the square shaped input passage at 45° so as to attain the rectangular shape of the output passage 22, which is oriented at 45° relative to the square shaped input 20.

Figure 3:
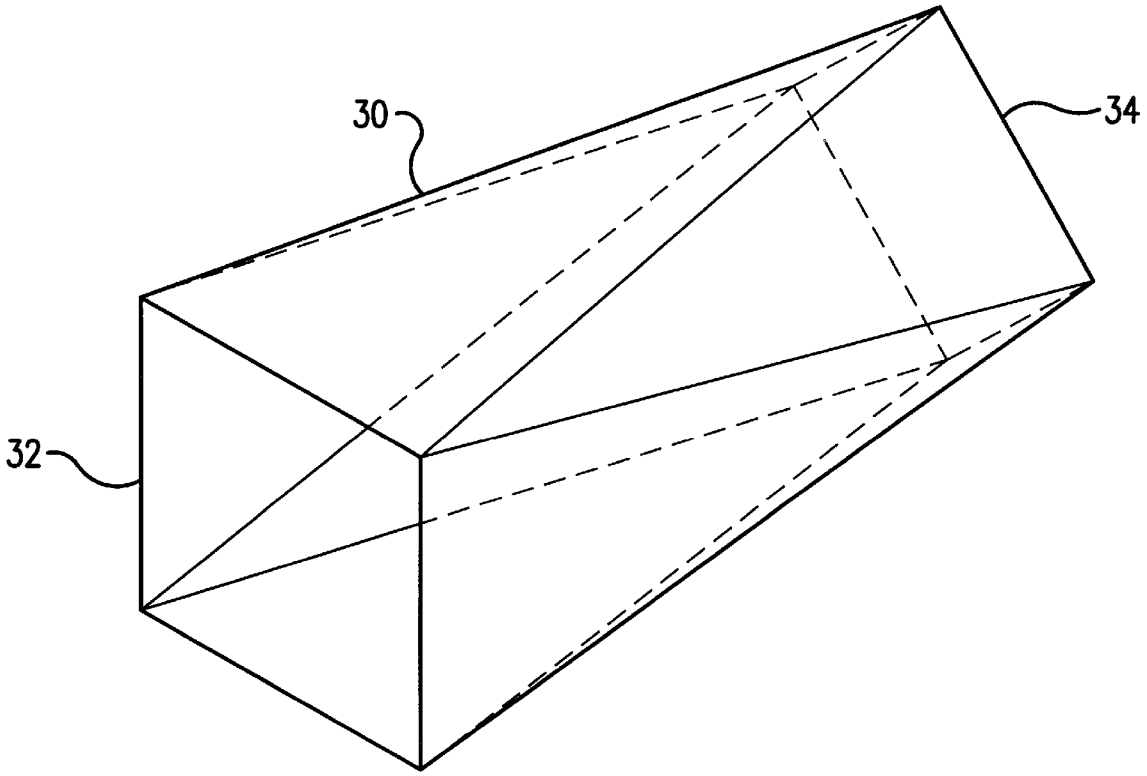
FIG. 3 is a diagram illustrating one preferred embodiment of the invention using a square-to-rectangular convergence transition structure.
Figure 4:
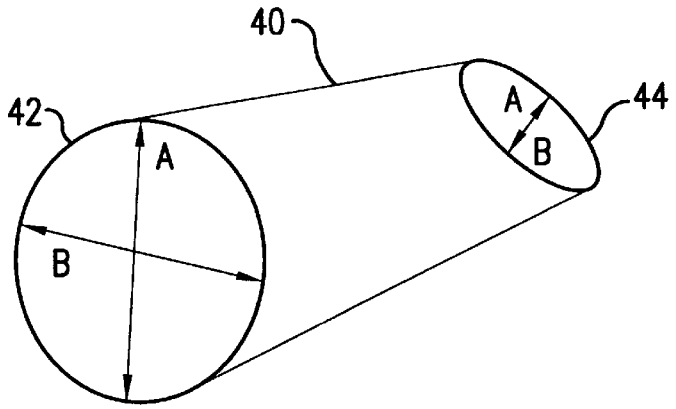
FIG. 4 is a diagram illustrating a second preferred embodiment of the invention using a circular-to-elliptical convergence transition structure.

The OMC may be implemented by a continuously tapering structure as shown by waveguide structure 30 in FIG. 3, having a square shaped input passage 32 and a rectangular shaped output passage 34, with a continuously varying cross-section therebetween. Alternatively, the OMC may also have a circular structure as shown in FIG. 4, wherein OMC 40 has a circularly shaped input passage 42 and an elliptically shaped output passage 44, with a continuously varying cross-section transitioning from the circular input passage to the elliptical output passage.

Figure 5:
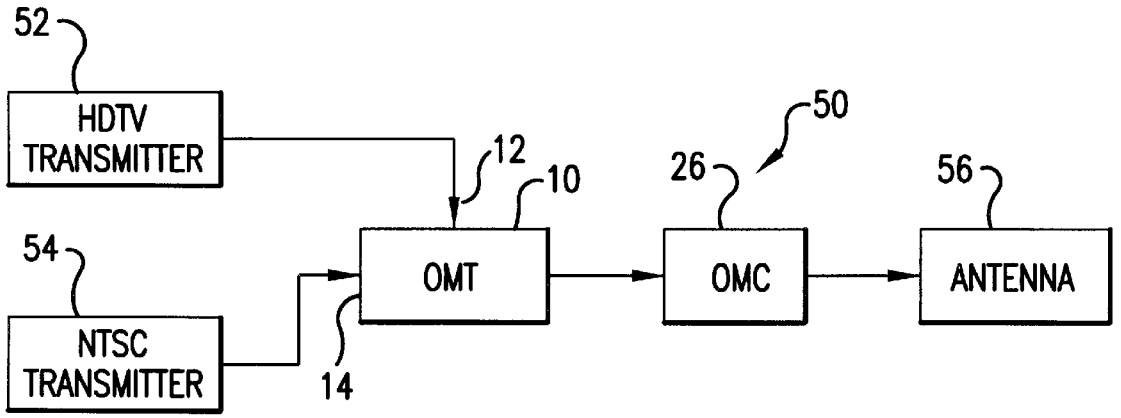
FIG. 5 is a diagram illustrating a television broadcast transmission system for broadcasting simultaneous television signals of two different formats according to the present invention.

One embodiment of a television broadcast transmitter system according to the present invention is shown in FIG. 5. System 50 includes a first transmitter 52 which provides a first RF television signal in a DTV format (such as HDTV), and a second transmitter 54 which provides a second RF television signal in a conventional NTSC format. The electromagnetic energy waves produced by transmitters 52 and 54 are coupled to inputs 12 and 14 of the OMT 10, and the combined orthogonal electromagnetic waves are outputted by the OMT at output 16 to the input of the OMC 26. In OMC 26 the electric field vector orientations of the two electromagnetic waves are converged to the same direction, and the realigned combined waves are then fed to the input coupling of a conventional broadcast antenna 56. Because of the isolation provided by the OMT 10, the two signals are kept isolated from one another to the extent necessary at the transmitters, while the OMC achieves the necessary convergence of the field orientation to allow the combined signals to be transmitted simultaneously over a common antenna 56.

It is also possible to use circulators or isolator devices at the inputs of the OMT and/or the output of the OMC to provide additional levels of isolation between the signals. It is further noted that the OMC of the present invention may be cascaded whereby more than two signals may be combined.

The invention having been thus described, it will be apparent to those skilled in the art that the same may be varied in many ways without departing from the spirit and scope of the inventions. All such modifications are intended to be encompassed by the following claims.

What is claimed is:

1. Apparatus for combining electromagnetic energy waves for transmission to a common propagation medium, comprising:

first waveguide means for receiving at separate inputs thereof two electromagnetic energy waves having electric field vectors orthogonally disposed with respect to each other, combining said orthogonally disposed waves and outputting the combined orthogonally disposed waves at a common output passage thereof; and second waveguide means for receiving at an input thereof said combined orthogonally disposed waves, converging said orthogonally disposed waves such that the electric field vectors thereof are disposed parallel to each other, and outputting the combined parallel disposed waves at an output passage thereof for transmission to a common propagation medium.

2. Apparatus as set forth in claim 1, wherein said common propagation medium is a common antenna.

3. Apparatus as set forth in claim 1, wherein said electromagnetic energy waves are radio frequency (RF) signals.

4. Apparatus as set forth in claim 3, wherein said RF signals are television broadcast signals.

5. Apparatus as set forth in claim 1, wherein said first waveguide means comprises an orthogonal mode transducer having a square waveguide section terminating in said common output, and first and second rectangular waveguide sections oriented orthogonally with respect to each other and being separately coupled to said square waveguide section.

6. Apparatus as set forth in claim 1, wherein said second waveguide means comprises a square-to-rectangular waveguide transition having a square shaped passage at one end, a rectangular shaped passage at the other end, and a continuously varying cross-section from square to rectangular between said ends, said rectangular shaped passage being oriented at 45° relative to said square shaped passage, said square shaped passage being coupled to said common output passage.

7. Apparatus as set forth in claim 1, wherein said second waveguide means comprises a circular-to-elliptical waveguide transition having a circularly shape passage at one end, an elliptically shaped passage at the other end, and a continuously varying cross-section from circular to elliptical between said ends, said elliptically shaped passage being oriented at a 45° angle relative to each of said orthogonal electric field vectors, said circularly shaped passage being coupled to said common output passage.

8. A television broadcast transmission system, comprising:

a first broadcast transmitter which outputs a first RF television signal electromagnetic energy wave in a first format;

a second broadcast transmitter which outputs a second RF television signal electromagnetic energy wave in a second format;

first waveguide means for receiving at separate inputs thereof said first and second electromagnetic energy waves having electric field vectors orthogonally disposed with respect to each other, combining said orthogonally disposed waves and outputting the combined orthogonally disposed waves at a common output passage thereof; and second waveguide means for receiving at an input thereof said combined orthogonally disposed waves, converging said orthogonally disposed waves such that the electric field vectors thereof are disposed parallel to each other, and outputting the combined parallel disposed waves at an output passage thereof for transmission to a common antenna.

9. A television broadcast transmission system as set forth in claim 8, wherein said first waveguide means comprises an orthogonal mode transducer having a square waveguide section terminating in said common output, and first and second rectangular waveguide sections oriented orthogonally with respect to each other and being separately coupled to said square waveguide section.

10. A television broadcast transmission system as set forth in claim 8, wherein said second waveguide means comprises a square-to-rectangular waveguide transition having a square shaped passage at one end, a rectangular shaped passage at the other end, and a continuously varying cross-section from square to rectangular between said ends, said rectangular shaped passage being oriented at 45° relative to said square shaped passage, said square shaped passage being coupled to said common output passage.

11. A television broadcast transmission system as set forth in claim 8, wherein said second waveguide means comprises a circular-to-elliptical waveguide transition having a circularly shape passage at one end, an elliptically shaped passage at the other end, and a continuously varying cross-section from circular to elliptical between said ends, said elliptically shaped passage being oriented at a 45° angle relative to each of said orthogonal electric field vectors, said circularly shaped passage being coupled to said common output passage.

* * * * *